US007303450B2

(12) United States Patent
Roset

(10) Patent No.: US 7,303,450 B2
(45) Date of Patent: Dec. 4, 2007

(54) ELECTRICAL TERMINAL ASSEMBLY

(75) Inventor: Josep Roset, Valls (ES)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 11/162,299

(22) Filed: Sep. 6, 2005

(65) Prior Publication Data

US 2007/0054568 A1 Mar. 8, 2007

(51) Int. Cl.
*H01R 4/10* (2006.01)

(52) U.S. Cl. ..... 439/877; 29/863

(58) Field of Classification Search ..... 439/865–868, 439/877–882; 29/863–867; 174/84 C, 74 R, 174/75 C See application file for complete search history.

(56) References Cited

U.S. PATENT DOCUMENTS 1,227,726 A 5/1917 Woodhead
2,456,118 A * 12/1948 Foster ..... 174/153 R
2,467,012 A 4/1949 Deuschle
2,480,280 A 8/1949 Bergan
3,366,566 A * 1/1968 Sandrock ..... 204/280
5,408,743 A * 4/1995 Tournier et al. ..... 29/863
6,613,263 B2 9/2003 Kondo
6,770,817 B2 * 8/2004 Kuwayama et al. ..... 174/84 C
6,783,377 B2 8/2004 Aoyama
2001/0003688 A1 6/2001 Kondo
2002/0127915 A1 9/2002 Kondo
2004/0253871 A1 12/2004 Sakatani

FOREIGN PATENT DOCUMENTS

DE 19843886 A1 3/2000

* cited by examiner

*Primary Examiner*—James R. Harvey
(74) *Attorney, Agent, or Firm*—Brooks Kushman P.C.

(57) ABSTRACT

Under the invention, a new electrical terminal assembly is provided. In one embodiment, the electrical terminal assembly comprises an electrical terminal made of an electrically conductive material and having a cavity to receive a wire assembly, and a wire assembly, comprising an electrically conductive wire and insulation surrounding the wire such that a portion of the wire assembly is insulated and a portion of the wire assembly is uninsulated. The wire assembly extends into the cavity of the electrical terminal such that the uninsulated portion of the wire assembly comes into contact with the electrical terminal. The electrical terminal is crimped at a first location around the insulated portion of the wire assembly which inhibits fluid from entering the portion of the cavity housing the uninsulated portion of the wire assembly.

20 Claims, 3 Drawing Sheets

ELECTRICAL TERMINAL ASSEMBLY

BACKGROUND OF THE INVENTION

1. Field of the Invention

The invention relates to an electrical terminal assembly.

2. Background Art

An electrical terminal assembly is disclosed herein. Examples of electrical terminal assemblies are disclosed in U.S. Pat. Nos. 6,613,263 and 6,783,377 and in U.S. Patent Application Publication Nos. US 2001/0003688 A1, US 2002/0127915 A1 and US 2004/0253871 A1.

SUMMARY OF THE INVENTION

Under the invention, a new electrical terminal assembly is provided. In one embodiment, the electrical terminal assembly comprises an electrical terminal made of an electrically conductive material and having a cavity and a wire assembly, comprising an electrically conductive wire and insulation surrounding the wire such that a portion of the wire assembly is insulated and a portion of the wire assembly is uninsulated. The wire assembly extends into the cavity of the electrical terminal such that the uninsulated portion of the wire assembly comes into contact with the electrical terminal. The electrical terminal is crimped at a first location around the insulated portion of the wire assembly which inhibits fluid from entering the portion of the cavity housing the uninsulated portion of the wire assembly.

Further under the invention, a method of making the electrical terminal assembly is provided. The method includes the steps of providing a wire assembly comprising an electrically conductive wire and insulation surrounding the wire such that a portion of the wire assembly is insulated and a portion of the wire assembly is uninsulated; providing a electrical terminal made of an electrically conductive material and having a cavity to receive the wire assembly; positioning the wire assembly in the cavity so that a portion of the uninsulated portion of the wire assembly and a portion of the insulated portion of the wire assembly are contained within the cavity; and crimping the electrical terminal around the insulated portion of the wire assembly at a first location to inhibit fluid from entering a portion of the cavity housing the uninsulated portion of the wire assembly.

While exemplary embodiments in accordance with the invention are illustrated and disclosed, such disclosure should not be construed to limit the claims. It is anticipated that various modifications and alternative designs may be made without departing from the scope of the invention.

BRIEF DESCRIPTION OF THE DRAWINGS

FIG. 5*d* is a perspective view depicting the insertion of a portion of the wire assembly into the electrical terminal.

DETAILED DESCRIPTION

The following descriptions are merely exemplary in nature and are in no way intended to limit the invention or its application or uses.

Figure 1:
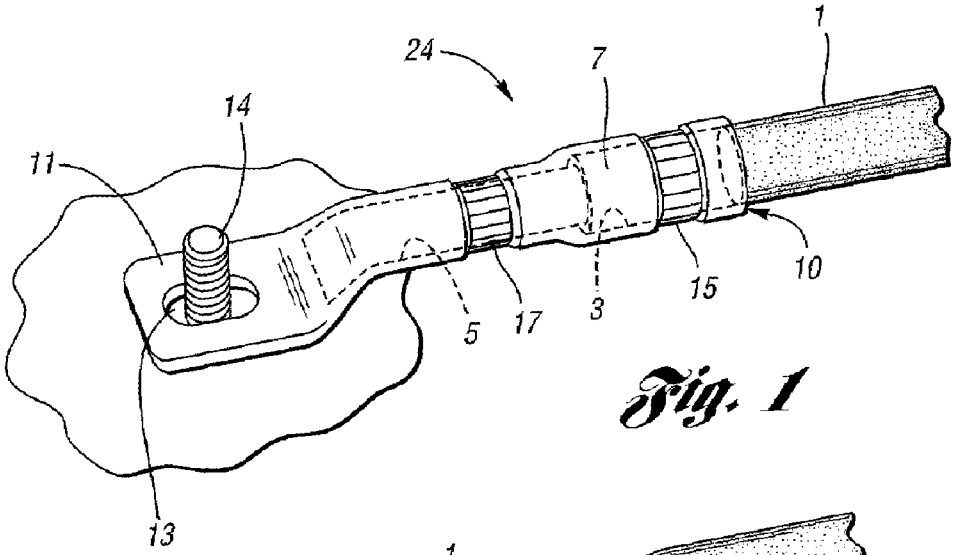
FIG. 1 is a perspective view of an electrical terminal assembly of the present invention showing a electrical terminal and a wire assembly extending into the electrical terminal.

FIG. 1 shows an electrical terminal assembly 24 according to the present invention mounted on a mounting member 14, such as a mounting stud of a vehicle battery, starter, alternator, vehicle body or any other suitable component. The electrical terminal assembly 24 includes a wire assembly 1, and an electrical terminal 7 for electrically connecting the wire assembly to the mounting member 14.

Figure 2:
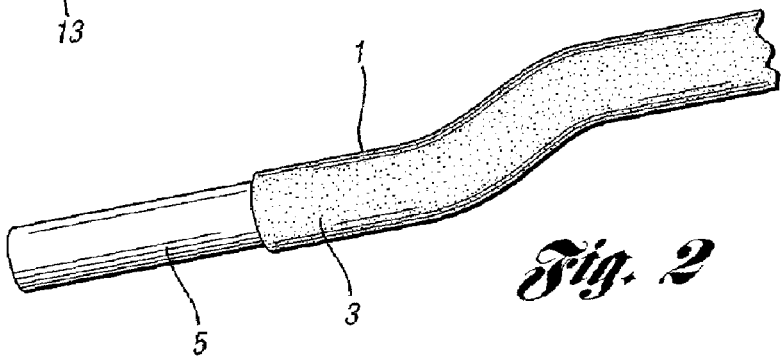
FIG. 2 is a perspective view of the wire assembly showing an electrically conductive wire surrounded by insulation, wherein a portion of the wire assembly is insulated and a portion of the wire assembly is uninsulated.

The wire assembly 1 comprises an electrically conductive wire surrounded by insulation having an insulated portion 3 and an uninsulated portion 5, as shown in FIGS. 1 and 2. The wire may be made from any suitable material.

Figure 3:
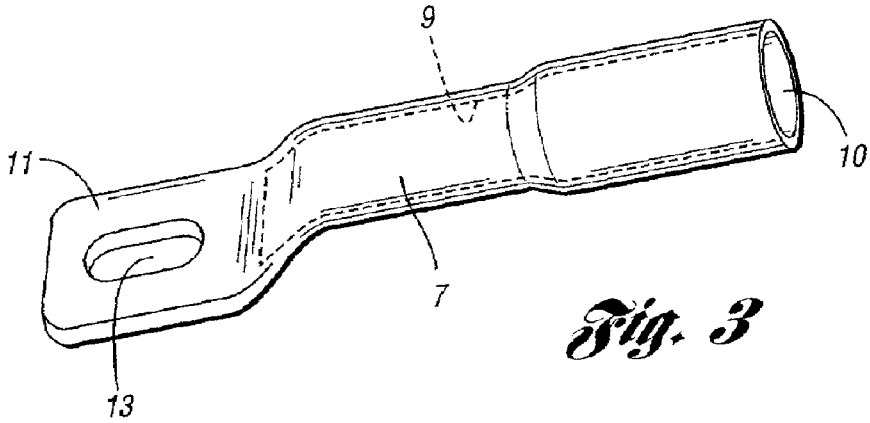
FIG. 3 is a perspective view of the electrical terminal showing a cavity for receiving the wire assembly, a contact zone and an adaptation for being mounted to a mounting member.

The electrical terminal 7 has an opening 10 into a cavity 9, an electrical contact zone 11 and an adaptation 13, such as an opening, for mounting the electrical terminal to a mounting member 14, as shown in FIGS. 1 and 3. The cavity 9 is depicted in phantom lines. The electrical terminal may be made of any suitable electrically conductive material including, but not limited to, copper zinc alloys.

Figure 4:
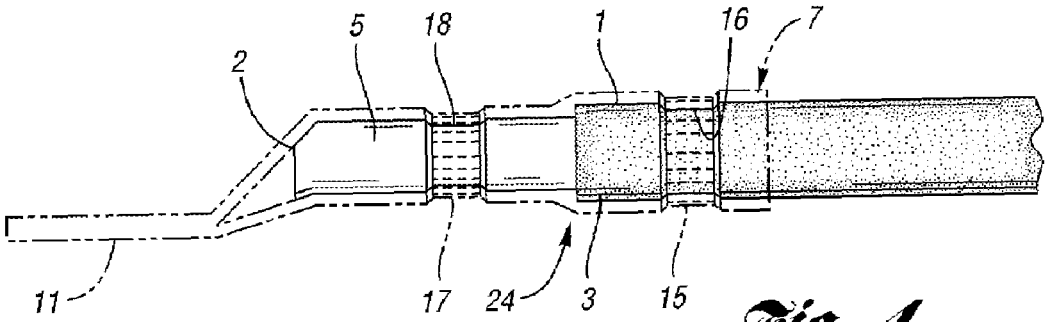
FIG. 4 is a side elevational view of the wire assembly received within the electrical terminal and crimped at two locations.

The wire assembly 1 extends into the cavity 9 of the electrical terminal through the opening 10 as shown in FIGS. 1 and 4.

The electrical terminal 7 has been crimped at a first location 15 as shown in FIGS. 1 and 4. At the first crimped location 15, the electrical terminal 7 is crimped around the insulated portion 3 of the wire assembly 1 such that it engages the insulation, thereby forming a seal (as shown in FIGS. 1 and 4) which inhibits fluid from entering a portion of the cavity 9 housing the uninsulated portion 5 of the wire assembly 1. Crimping the electrical terminal 7 at the first location 15 may also cause a deformation 16 of the insulated portion 3 of the wire assembly 1 as shown in FIG. 4.

The electrical terminal 7 is crimped at a second location 17, preferably around an uninsulated portion 5 of the wire assembly 1, as shown in FIGS. 1 and 4. Crimping at the second location 17 serves to strengthen the grip that the electrical terminal 7 has on the wire assembly 1. Crimping the electrical terminal 7 at the second location 17 may also cause a deformation 18 in the wire assembly 1 as shown in FIG. 4. If the portion of the wire assembly 1 that is engaged by the electrical terminal 7 at the second crimping location 17 is the uninsulated portion 5 of the wire assembly 1, then the electrical terminal 7, which is made of an electrically conductive material, comes into contact with the uninsulated portion 5 of the wire assembly and forms an electrical connection. An electrical connection may also be formed by inserting the wire assembly 1 into the cavity of the electrical terminal 7 such that the uninsulated portion 5 comes into contact with walls of the cavity.

FIG. 4 is a side elevational view of the wire assembly 1 received within the electrical terminal 7 after the electrical terminal 7 has been crimped at the first location 15 and the second location 17. The electrical terminal 7 is depicted in phantom lines. Deformation of the insulated portion 3 of the wire assembly 1 may occur in the vicinity of the first crimped location 15. Such deformation is depicted at reference numeral 16. Additional deformation of the wire assembly 1 may occur in the vicinity of the second crimped location 17. This is depicted at reference numeral 18 as deformation of the uninsulated portion 5 of the wire assembly 1. The deformation 18 of the uninsulated portion 5 of the wire assembly 1 is one way of establishing electrical contact between the uninsulated portion 5 of the wire assembly 1 and the electrical terminal 7. An alternate or additional contact 2 between the uninsulated portion 5 of the wire assembly 1 and the electrical terminal 7 is also depicted at reference numeral 2.

Referring to FIGS. 5*a*-5*f*, an exemplary method of making the electrical terminal assembly will now be described.

Figure 5C:
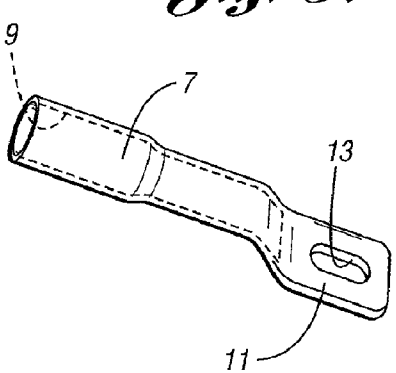
FIG. 5*c* depicts the electrical terminal formed by the process of engaging the hollow metal tube with the forming device.
Figure 5B:
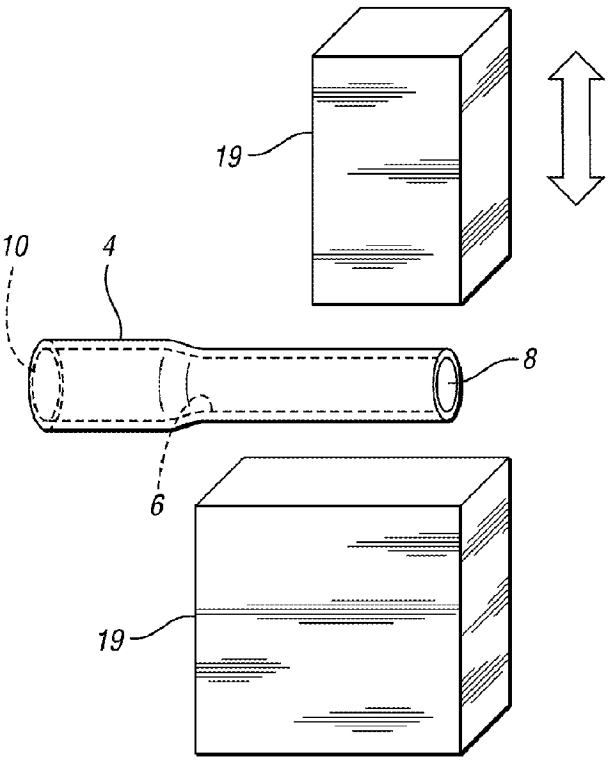
FIG. 5*b* is a perspective view of a forming device engaging the hollow metal tube to form the electrical terminal.
Figure 5A:
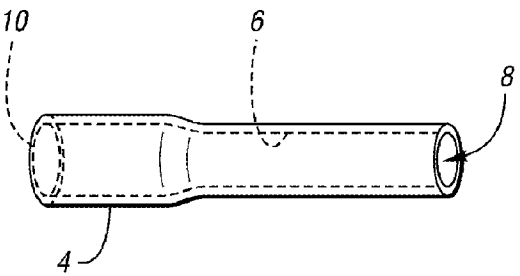
FIG. 5*a* is a perspective view of a hollow metal tube for use in making the electrical terminal.

In FIG. 5*a*, a hollow tube 4, made of an electrically conductive material such as a copper zinc alloy, and having an opening at both ends 8, 10 is provided. The hollow portion is depicted at reference numeral 6 with phantom lines.

In FIG. 5*b*, the hollow tube 4 is engaged by a forming device 19, such as a press, which compresses the hollow tube 4, at least partially closing the opening (either 8 or 10) at one end of the hollow tube 4.

FIG. 5*c* depicts the electrical terminal 7 having a cavity 9, an electrical contact zone 11, and an adaptation 13 for mounting the electrical terminal to a mounting member. The electrical terminal 7 was formed by the process depicted in FIGS. 5*a* and 5*b*.

In FIG. 5*d*, the wire assembly 1, comprising the electrically conductive wire surrounded by insulation such that a portion of the wire assembly is insulated 3 and a portion of the assembly is uninsulated 5, is provided. A portion of the wire assembly 1, including a portion of the insulated portion 3 and a portion of the uninsulated portion 5 is inserted into the cavity 9 of the electrical terminal 7 through the opening 10.

Figures 5B, 5E, 5F:
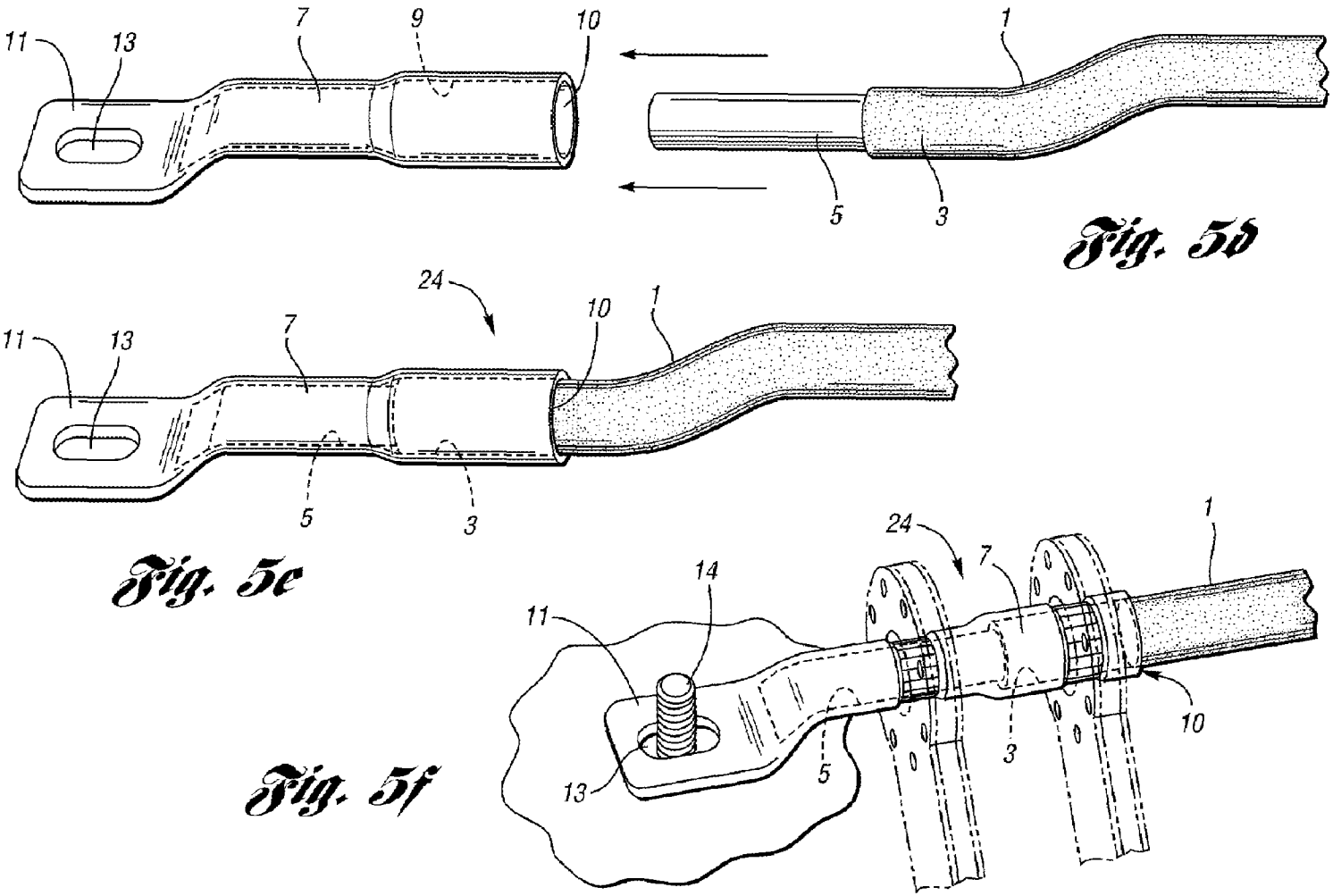
FIG. 5*e* is a perspective view depicting the wire assembly received within the electrical terminal.
FIG. 5*f* is a perspective view of the electrical terminal assembly showing the crimping of the electrical terminal around the wire assembly at two locations and also showing the electrical terminal mounted to a mounting member.

In FIG. 5*e* is a perspective view of the electrical terminal assembly depicting an insulated portion 3 and an uninsulated portion 5 of the wire assembly 1 resting within the cavity of the electrical terminal 7.

FIG. 5*f* is a perspective view of the electrical terminal assembly depicting the steps of crimping the electrical terminal 7 at a first location 15 around an insulated portion 3 of the wire assembly 1. The step of crimping the electrical terminal at a second location 17 is also depicted. The electrical terminal assembly is shown mounted to a mounting member 14 at its adaptation for mounting 13 such that the electrical contact zone 11 comes into contact with the mounting member.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An electrical terminal assembly comprising:

a wire assembly comprising an electrically conductive wire and insulation surrounding the wire such that a portion of the wire assembly is insulated and a portion of the wire assembly is uninsulated; and an electrical terminal made of an electrically conductive material and having a cavity that receives the wire assembly, the cavity having a substantially constant internal diameter throughout a substantial portion of the cavity;

wherein the wire assembly extends into the cavity so that a portion of the uninsulated portion and a portion of the insulated portion are contained within the cavity, and the uninsulated portion is in contact with the electrical terminal, wherein the electrical terminal is crimped at a first location around the insulated portion of the wire assembly to inhibit fluid from entering a portion of the cavity housing the uninsulated portion of the wire assembly and wherein the electrical terminal is crimped at a second location around the wire assembly, the second location having substantially the same internal diameter as the internal diameter of the first location.

2. The electrical terminal assembly of claim 1 wherein the electrical terminal has an electrical contact zone and is adapted to be fixed to a mounting member.

3. The electrical terminal assembly of claim 1 wherein the electrical terminal has only one opening to the cavity, and the wire assembly sufficiently fills the opening to thereby inhibit fluid from entering a portion of the cavity housing the uninsulated portion of the wire assembly.

4. The electrical terminal assembly of claim 1 wherein at the second location, the electrical terminal is crimped around the uninsulated portion of the wire assembly causing the electrical terminal to contact the uninsulated portion of the wire assembly.

5. The electrical terminal assembly of claim 4 wherein the electrical terminal has an electrical contact zone and is adapted to be fixed to a mounting member.

6. The electrical terminal assembly of claim 4 wherein the electrical terminal has only one opening to the cavity, and the wire assembly sufficiently fills the opening to thereby inhibit fluid from entering a portion of the cavity housing the uninsulated portion of the wire assembly.

7. A method of making an electrical terminal assembly comprising:

providing a wire assembly comprising an electrically conductive wire and insulation surrounding the electrically conductive wire such that a portion of the wire assembly is insulated and a portion of the wire assembly is uninsulated;

providing an electrical terminal, made of an electrically conductive material, having a cavity to receive the wire assembly, the cavity having a substantially constant internal diameter throughout a substantial portion of the cavity;

positioning the wire assembly in the cavity so that a portion of the uninsulated portion and a portion of the insulated portion are contained within the cavity;

crimping the electrical terminal around the insulated portion of the wire assembly at a first location to inhibit fluid from entering a portion of the cavity housing the uninsulated portion of the wire assembly; and crimping the electrical terminal at a second location around the wire assembly, the second location having substantially the same internal diameter as the internal diameter of the first location.

8. The method of claim 7 wherein the electrical terminal has an electrical contact zone and is adapted to be fixed to a mounting member.

9. The method of claim 7 wherein the electrical terminal has only one opening to the cavity, and the wire assembly sufficiently fills the opening to thereby inhibit fluid from entering a portion of the cavity housing the uninsulated portion of the wire assembly.

10. The method of claim 7 wherein at the second location, the electrical terminal is crimped around the uninsulated portion of the wire assembly causing the electrical terminal to contact the uninsulated portion of the wire assembly.

11. The method of claim 10 wherein the electrical terminal has an electrical contact zone and is adapted to be fixed to a mounting member.

12. The method of claim 10 wherein the electrical terminal has only one opening to the cavity, and the wire assembly sufficiently fills the opening to thereby inhibit fluid from entering a portion of the cavity housing the uninsulated portion of the wire assembly.

13. The method of claim 7 wherein the wire assembly is positioned in the cavity such that a portion of the uninsulated portion of the wire assembly contacts a terminus of the cavity.

14. A method of making an electrical terminal assembly comprising:

engaging a hollow metal tube having a substantially constant internal diameter and having an opening at each end with a forming device to at least partially compress a portion of the tube to form a electrical terminal having a cavity having a substantially constant internal diameter throughout a substantial portion of the cavity;

positioning a portion of a wire assembly in the cavity, wherein the wire assembly comprises an electrically conductive wire and insulation surrounding the wire such that a portion of the wire assembly is insulated and a portion of the wire assembly is uninsulated;

crimping the electrical terminal at a first location around the insulated portion of the wire assembly to inhibit fluid from entering a portion of the cavity housing the uninsulated portion of the wire assembly; and crimping the electrical terminal at a second location around the wire assembly, the second location having substantially the same internal diameter as the internal diameter of the first location.

15. The method of claim 14 wherein the forming device engages the hollow metal tube to form an electrical contact zone, and wherein the electrical terminal is adapted to be fixed to a mounting member.

16. The method of claim 14 wherein the electrical terminal has only one opening to the cavity, and the wire assembly sufficiently fills the opening to thereby inhibit fluid from entering a portion of the cavity housing the uninsulated portion of the wire assembly.

17. The method of claim 14 wherein at the second location, the electrical terminal is crimped around the uninsulated portion of the wire assembly causing the electrical terminal to contact the uninsulated portion of the wire assembly.

18. The method of claim 17 wherein the forming device engages the hollow metal tube to form an electrical contact zone and wherein the electrical terminal is adapted to be fixed to a mounting member.

19. The method of claim 17 wherein the electrical terminal has only one opening to the cavity, and the wire assembly sufficiently fills the opening to thereby inhibit fluid from entering a portion of the cavity housing the uninsulated portion of the wire assembly.

20. The method of claim 14 wherein the wire assembly is positioned in the cavity such that a portion of the uninsulated portion of the wire assembly contacts a terminus of the cavity.

* * * * *